US005533689A

United States Patent [19]

Chalfant

[11] Patent Number: 5,533,689

[45] Date of Patent: Jul. 9, 1996

[54] BANDAGE WINDING MACHINE

[76] Inventor: Michael G. Chalfant, 37 Crestland Ter., Doylestown, Pa. 18901

[21] Appl. No.: 257,541

[22] Filed: Jun. 9, 1994

[51] Int. Cl.[6] ..... B65H 18/10

[52] U.S. Cl. ..... 242/532.5

[58] Field of Search ..... 242/532, 532.5, 242/DIG. 2

[56] References Cited

U.S. PATENT DOCUMENTS

| | | | |
|---|---|---|---|
| 72,569 | 12/1867 | Tremper | 242/532.5 |
| 94,807 | 9/1869 | Young et al. | 242/532.5 |
| 649,694 | 5/1900 | Hunter | 242/532.5 |
| 653,603 | 7/1900 | Young | 242/DIG. 2 |
| 1,070,141 | 8/1913 | Kurowski | 242/532.5 |
| 1,287,163 | 12/1918 | Winter . | |
| 1,337,169 | 5/1921 | Maize | 242/532.5 |
| 1,991,926 | 2/1935 | Gregory et al. | 242/532.5 |
| 2,571,175 | 10/1951 | Williams et al. | 242/532.6 |
| 2,765,124 | 1/1952 | Sickles . | |
| 3,113,742 | 5/1961 | Bevan et al. . | |
| 3,516,618 | 6/1970 | Reinke . | |
| 3,653,602 | 4/1972 | Harrington . | |
| 3,958,499 | 5/1976 | Albee, Jr. | 242/532.5 |
| 4,061,287 | 12/1977 | Shakespeare . | |
| 4,161,298 | 7/1979 | Davis . | |
| 4,531,684 | 7/1985 | Mills | 242/532.5 |

FOREIGN PATENT DOCUMENTS

| | | | |
|---|---|---|---|
| 1548145 | 3/1990 | U.S.S.R. | 242/532.5 |

*Primary Examiner*—John P. Darling
*Attorney, Agent, or Firm*—Synnestvedt & Lechner

[57] ABSTRACT

A bandage winding machine for forming rolls of bandage from unrolled strips which has a shaft and a clamping bar attached at one end of the shaft for securing the beginning end of the bandage. A clamp couples the other end of the clamping bar with the shaft to securely hold the beginning end of the bandage between the shaft and clamping bar. The clamping bar is moveable to allow easy placement of the starting end of the bandage between the clamping bar and the shaft.

15 Claims, 2 Drawing Sheets

BANDAGE WINDING MACHINE

BACKGROUND OF THE INVENTION

1. Field of the Invention

The present invention pertains to a winding machine. More particularly, the invention relates to a device for winding lengths of bandage such as elastic bandages into compact rolls.

2. Description of the Related Art

Rolled bandages have a wide variety of medical and therapeutic uses. For example, elastic bandage rolls are used by athletes, medical personnel, and patients to wrap and protect different parts of the body.

Many users, such as hospitals and medical clinics, wind and rewind vast numbers of elastic bandages. Moreover, people with particular medical problems such as lymphedema are required to continually use elastic bandages to control their disease.

Various devices have been developed to wind and rewind bandages into convenient rolls. These devices, however, are not easy to use and can be especially troublesome for physically challenged people or people lacking dexterity such as the ill or those with arthritis.

One problem with previous known winding devices is the difficulty starting a new bandage roll. Devices such as U.S. Pat. No. 4,161,298 to Davis and U.S. Pat. No. 3,516,618 to Reinke have rigid shafts that rotate to wind the lengths of bandage. To start a new roll, the starting end of the bandage length must be affixed to this shaft so that the shaft will roll up the bandage. These prior devices require the user to "thread" the starting end through a thin slot in the shaft or in between the shaft and a parallel guide strip to affix the starting end, a tedious and difficult task for many who lack the necessary dexterity, much like threading a very large thread into a needle hole.

Accordingly, one object of the invention is to provide a wrapping device that is easier to start, hold, and remove the bandage from the wrapping shaft.

Another object is to provide a device that eliminates the need to thread the starting end of the bandage onto the shaft.

Additional objects, advantages and novel features of the invention will be set forth in part in the description that follows, and in part will become apparent from the description or can be learned by practice of the invention. The advantages of the present invention can be realized and obtained by the device particularly pointed out in the appended claims.

SUMMARY OF THE INVENTION

The present invention provides a unique bandage winding machine that is easier to begin winding a new roll of bandage. The invention has a shaft that rotates to wind the bandage. A driver, such as an electric motor, rotates the shaft. A moveable clamping bar, affixed at one end to the shaft and rotating with it, holds the beginning end of the bandage securely to the shaft. A clamp couples the other end of the clamping bar to the shaft to securely hold the beginning end of the bandage between the shaft and the clamping bar.

The present invention provides a winding machine that is far more easily used than any presently available ones. The machine is easily used by people who may not have the coordination or dexterity to use the other machines.

BRIEF DESCRIPTION OF THE DRAWINGS

The foregoing summary, as well as the following detailed description will be better understood when read in conjunction with the appended figures. For the purpose of illustrating the invention, a preferred embodiment is shown. It is understood, however, that the invention is not limited to the precise arrangement and instrumentalities shown.

FIG. 1B is an enlarged view of the connection between the clamping bar and shaft.

DETAILED DESCRIPTION

Figure 1A:
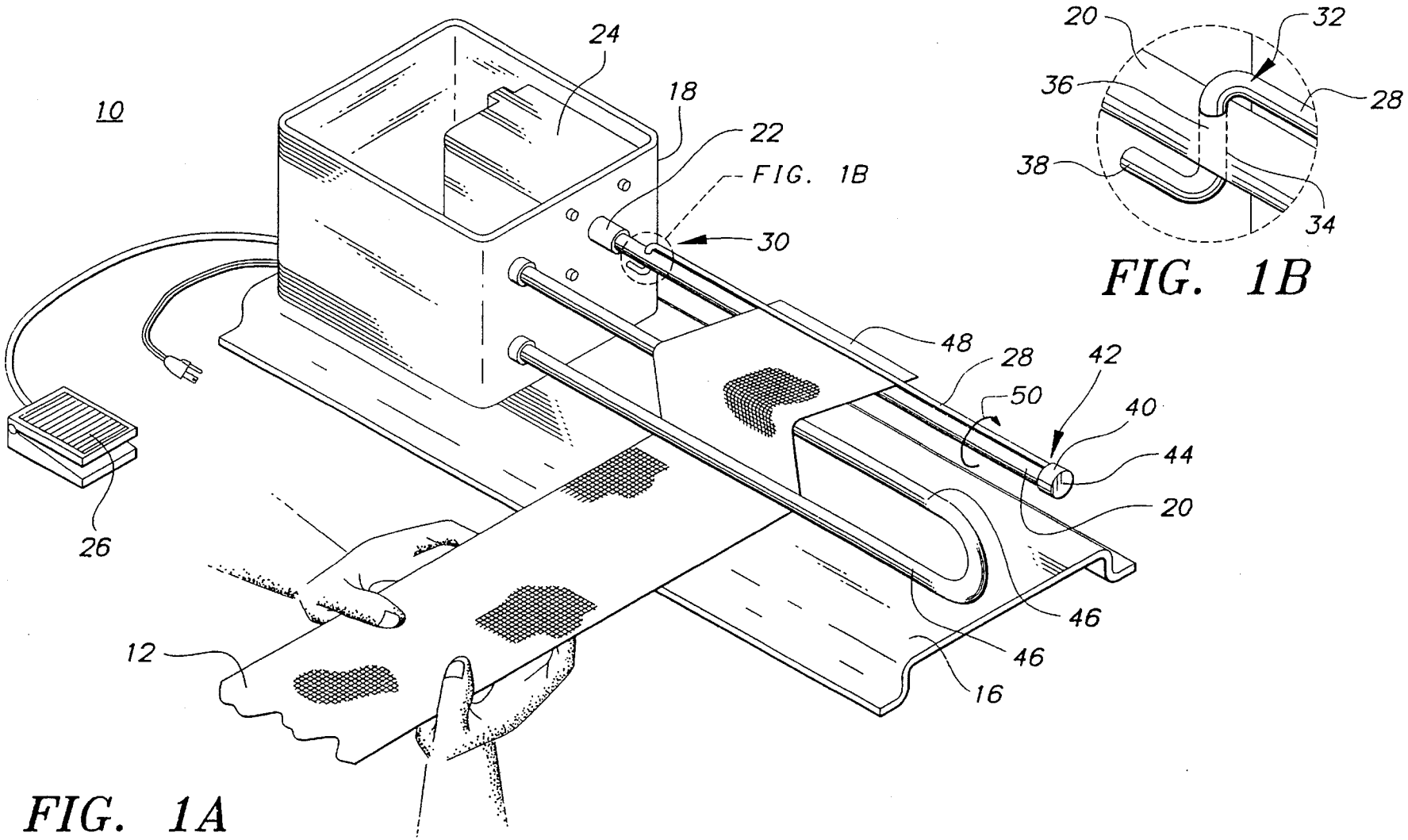
FIG. 1A is a perspective view of a bandage winding machine of the present invention, shown with a starting end of the bandage secured between the shaft and the clamping bar.
Figure 2:
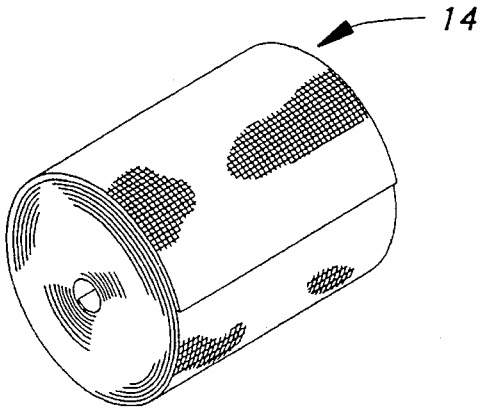
FIG. 2 is a perspective view of a bandage roll wound with the machine of FIG. 1.

The present invention comprises a bandage winding machine that is easy and convenient to secure a beginning end of a bandage strip to begin a new roll. Reference is now made to FIGS. 1A, 1B, 2, and 3 which illustrate a preferred embodiment of the present invention.

A winding machine 10 for winding elastic bandage strips 12 into bandage rolls 14 is shown. The machine 10 has a support frame 16 comprising a motor housing 18. The frame can be made of any suitable material for supporting the various elements of the machine, including sheet metal.

Extending longitudinally from the housing 18 is a shaft 20 which rotates to roll up unwound strips of bandage. The shaft 20 has a coupling 22 for connecting the shaft to a driver 24 for rotating the shaft 20.

The driver 24 is mounted to the frame 16 within the housing 18 and rotates the shaft 20 to wind the bandage. The driver 24 preferably is an electric motor gear reduced to approximately 120 rotations per minute to allow for hand winding operation. It is recognized, however, that any suitable driver device for rotating the shaft 20 may be used. An electrical foot switch 26 is also preferable for controlling the electric motor, thereby freeing the operator's hands for handling the bandage 12 during operation of the machine 10 as well as for convenience.

Extending substantially parallel to the shaft 20 is a moveable clamping bar 28 for securing the beginning end of the bandage between the clamping bar 28 and the shaft 20. The clamping bar 28 is affixed to the shaft 20 at one end 30 and thereby rotates with the shaft 20.

The clamping bar 28 is hingedly affixed to the shaft 20 at the end 30 so that the clamping bar 28 can move or swing away from the shaft 20 for ease of securing the beginning end of the bandage or for removing a completed bandage roll. In the illustrated embodiment, such movement is provided for by the hinged connection 32 having a drilled hole (opening) 34 through the shaft 20 through which fits a pivot section 36 formed by bending the clamping bar 28 as shown. An end section 38, bent from pivoting section 36, permanently secures the clamping bar 28 to the shaft 20 without preventing or interfering with the movement or swinging of the clamping bar 28. Thus it is seen that the clamping bar 28 can be swung about the axis of pivot section 36 and moved away from the shaft 20 when necessary.

Those skilled in the art will recognize that other suitable means for movably affixing the clamping bar 28 to the shaft 20 may be used. For example, the clamping bar 28 could be attached to the shaft by a flexible material such as a spring or piece of rubber which allows the clamping bar to swing away from the shaft.

A clamp 40 is provided to couple the other end 42 of the clamping bar 28 to the shaft 20 to securely hold the beginning end of the bandage strip in between the two. In the illustrated embodiment, this clamp preferably comprises an end cap 44 having an opening to fit over the ends of both the shaft 20 and the clamping bar 28 to effectively clamp or couple the two together.

A set of guide rails 46 supported by the frame 16 via the housing 18 guide and smooth the bandage strip as it is wound into the roll 14 on shaft 20.

Figure 3:
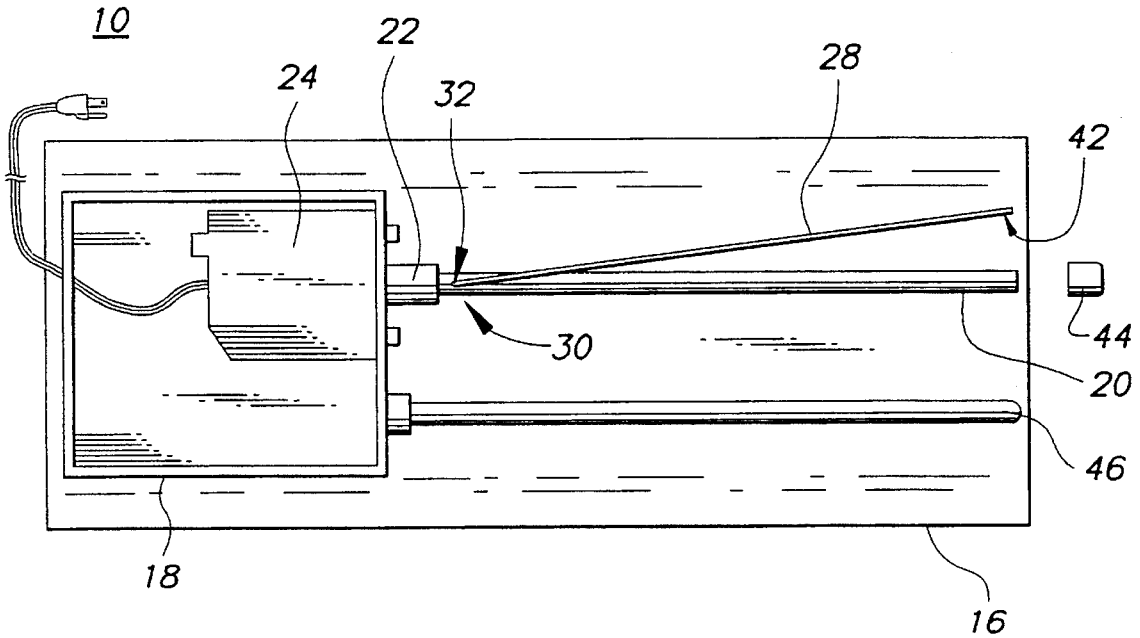
FIG. 3 is a top view of the machine of FIG. 1 shown with its clamping bar swung away from the shaft, and its motor housing cover removed.

The operation of the winding machine is now described. The end cap 44 is removed and the clamping bar 28 moved away from the shaft 20 as shown in FIG. 3. A starting end 48 of the bandage strip 12 is fed through the guide rails 46 as shown and placed over the shaft 20. The clamping bar 28 is then swung back to secure the bandage between the clamping bar 28 and shaft 20, and the end cap 44 is replaced around the clamping bar 28 and shaft 20 to maintain the securing hold of the bandage between the shaft and bar.

The operator then causes the shaft 20 to rotate by operating the foot switch 26 (rotating in the clockwise direction 50 in the preferred embodiment), winding the bandage strip into a roll 14. While the bandage strip is being wound, the operator can use its hands to help guide the strip through the guide rails 46. Once completed, the roll is removed by removing the end cap 44 and sliding the roll 14 off of the shaft 20.

While particular embodiments of the present invention are described herein, it is not intended to limit the invention to such disclosure and changes and modifications may be incorporated and embodied within the scope of the appended claims.

I claim:

1. A winding device comprising:

a shaft;

a driver connected to said shaft for rotating said shaft;

a moveable clamping bar affixed at a first end to and rotating with said shaft, wherein said first end of said clamping bar is affixed to said shaft through an opening through said shaft, said clamping bar having a section extending through said opening, and another section extending substantially parallel to said shaft;

a clamp for coupling the other end of said clamping bar with said shaft; and wherein said clamp comprises a removeable end cap fitting over both said shaft and said clamping bar.

2. A winding device in accordance with claim 1 wherein said clamping bar is adapted to swing away from said shaft when said clamp is removed.

3. A winding device in accordance with claim 1 wherein said shaft comprises a coupling connecting said shaft to said driver.

4. A winding device in accordance with claim 3 wherein said driver comprises an electric motor and gears.

5. A winding device in accordance with claim 1 further comprising guide rails affixed to the device.

6. A winding device in accordance with claim 5 further comprising a foot operated switch electrically connected to said driver for controlling the rotation of said shaft.

7. A device for winding bandages, comprising:

a frame;

a shaft for wrapping the bandage;

a driver supported by said frame and connected to said shaft for rotating said shaft;

a moveable clamping bar extending substantially parallel to said shaft and connected at a first end to said shaft to rotate with it, said moveable clamping bar being hingeably connected at said first end through an opening in said shaft so that said clamping bar can swing away from said shaft;

a clamp for clamping an other end of said clamping bar with said shaft to securely hold a beginning end of the bandage between said shaft and said clamping bar; and wherein said clamp comprises a removeable cap that fits around both said shaft and said clamping bar.

8. A device in accordance with claim 7 wherein said shaft comprises a coupling connecting said shaft to said driver.

9. A device in accordance with claim 7 wherein said driver is an electric motor.

10. A device in accordance with claim 9 further comprising a foot switch electrically connected to said motor for operating the device.

11. A device in accordance with claim 10 further comprising guide rails affixed to said frame for guiding the bandage onto said shaft.

12. A winding device in accordance with claim 7 wherein said clamping bar has a section extending through said opening.

13. A machine for wrapping bandage, comprising:

a frame;

a shaft for wrapping the bandage;

an electric motor connected to said shaft for rotating said shaft;

a moveable clamping bar hingeably attached at a first end to the shaft and extending substantially parallel to said shaft, said clamping bar rotating with said shaft, and wherein said clamping bar is attached at said first end to said shaft through an opening through said shaft; and a removable end cap for coupling the other end of said clamping bar to said shaft to secure the beginning end of the bandage between said shaft and said clamping bar.

14. A machine in accordance with claim 13 wherein said electric motor is connected to said shaft by gears.

15. A winding device in accordance with claim 13 wherein said clamping bar extends through said opening through said shaft.

* * * * *